US010646046B1

(12) United States Patent
Tilton

(10) Patent No.: US 10,646,046 B1
(45) Date of Patent: May 12, 2020

(54) WORKER'S BACK SUPPORT

(71) Applicant: Steven A. Tilton, Baltimore, MD (US)

(72) Inventor: Steven A. Tilton, Baltimore, MD (US)

( * ) Notice: Subject to any disclaimer, the term of this patent is extended or adjusted under 35 U.S.C. 154(b) by 467 days.

(21) Appl. No.: 15/731,769

(22) Filed: Jul. 31, 2017

(51) Int. Cl.
*A47C 16/00* (2006.01)
*B65D 43/22* (2006.01)
*B65D 43/16* (2006.01)
*B65D 25/04* (2006.01)

(52) U.S. Cl.
CPC ..... *A47C 16/005* (2013.01); *B65D 25/04* (2013.01); *B65D 43/16* (2013.01); *B65D 43/22* (2013.01)

(58) Field of Classification Search
CPC ..... A47C 16/005; B65D 43/16; B65D 43/22; B65D 25/04
See application file for complete search history.

(56) References Cited

U.S. PATENT DOCUMENTS 1,976,170 A * 10/1934 Hoover ..... A47C 16/04 182/230
2,839,766 A * 6/1958 Hull ..... A47C 16/00 5/632
3,677,569 A * 7/1972 Larson ..... B62B 3/02 280/32.6
4,970,742 A 11/1990 Keener
4,986,558 A 1/1991 Morris
D318,392 S 7/1991 Edelson
5,494,305 A 2/1996 Chen
5,624,126 A 4/1997 Vosbikian et al.
D406,210 S * 3/1999 Johnson ..... D6/349
6,122,811 A 9/2000 Shirley
6,292,964 B1 9/2001 Rose
6,902,174 B2 6/2005 Hernandez et al.
7,007,328 B1 3/2006 Bailey
D540,950 S * 4/2007 Johnson ..... D24/183
8,505,138 B1 * 8/2013 Minichiello ..... A47C 16/00 280/32.6
D771,414 S 11/2016 Krishtul
10,156,302 B1 * 12/2018 Giattina ..... H02G 3/0456
2006/0080780 A1 * 4/2006 Schlieps ..... A47C 9/027 5/657
2006/0200909 A1 * 9/2006 Beck ..... A47C 9/027 5/652
2011/0049822 A1 * 3/2011 Hinman ..... B25H 5/00 280/32.6
2017/0137184 A1 * 5/2017 Burek ..... B65D 43/162

* cited by examiner

*Primary Examiner* — Robert G Santos
*Assistant Examiner* — Alexis Felix Lopez
(74) *Attorney, Agent, or Firm* — Paul R. Martin

(57) ABSTRACT

A wedge-shaped support unit that is used in the manner of a mechanic's creeper to support a worker while he repairs items located above him and for which he must lie on his back. The unit includes a tool box section in which items, such as screws, washers and the like are stored and a section which supports workpieces, such as pipes for cutting. The tool box section and the work support section are located on the bottom of the unit. The work support section includes notches in the bottom edge of one side wall of the unit and blind-ended bores defined in the other side wall. Workpieces are supported in the notches and have their ends supported in the bores. The unit has multiple functions: a support for a worker; a tool box to store items; and a work support for holding workpieces.

12 Claims, 5 Drawing Sheets

WORKER'S BACK SUPPORT

TECHNICAL FIELD OF THE INVENTION

The present invention relates to the general art of tools, and to the particular field of supports for a workman. The present invention relates to a device intended to be used by a plumber or handyman in situations in which that person needs to be recumbent and positioned on his/her back while working.

BACKGROUND OF THE INVENTION

In performing a task, such as repairing a sink, or the like, a workman is often required to work from a supine position for long periods of time. The workman is often required to keep his arms raised during the task. Such positioning is tiring and taxing and requires frequent breaks. Even with such breaks, the work position can be detrimental over a long period. Fatigue may detract from efficient and accurate performance of the work.

While support devices, such as mechanic's creepers, are known for some fields, the inventor is not aware of any support device that is efficiently applicable to in home work such as above described.

Still further, support devices known to the inventor are often cumbersome to store and use, especially of the work is to be performed in an area that has furniture or the like that is susceptible to marring or damage if the support device collides with such furniture.

Prior art devices have failed to provide a device which provides adequate support, but which is readily transportable between job locations. Accordingly, it is an object of the present invention to provide such a device.

Often, a single job may require several tools and or accessories, such as bolts, nuts, screws, washers, or the like. This means that the workman must carry a toolbox with him. Adding a toolbox to an already cumbersome supporting device exacerbates the situation. The inventor is not aware of any support device that can double as a toolbox whereby multiple functions for a single device can be performed.

Since prior devices have failed to provide adequate support while also performing multiple functions, it is an object of the present invention to provide such a device.

Still further, it is often necessary for a workman to perform work on a workpiece. For example, in the situation of fixing a sink, it may be necessary to cut a pipe. This may require the workman to carry the pipe out to a truck or a workbench. Such a requirement is time consuming. The inventor is not aware of any device that will support a worker in a comfortable position while he works on workpieces that may be located in a confined area that requires him to work for long periods of time in a supine position but which will also perform multiple functions include acting as a workpiece support bench that is easily located closely adjacent to the work area thereby eliminating the need to carry the workpiece out to a remotely-located workbench.

It is yet another object of the present invention to provide a device that provides adequate support while also providing a workpiece support section in which workpieces often encountered during the work being performed can be supported while being repaired.

SUMMARY OF THE INVENTION

The above-discussed disadvantages of the prior art are overcome and the above-stated objects, as well as other objects, are provided by a wedge-shaped support unit that is used in the manner of a mechanic's creeper to support a worker while he repairs items located above him and for which he must lie on his back. The unit includes a tool box section in which items, such as screws, washers and the like are stored and a section which supports workpieces, such as pipes for cutting. The tool box section and the work support section are located on the bottom of the unit. The work support section includes notches in the bottom edge of one side wall of the unit and blind-ended bores defined in the other side wall. Workpieces are supported in the notches and have their ends supported in the bores. The unit has multiple functions: a support for a worker; a tool box to store items; and a work support for holding workpieces.

When fixing a sink, or similar unit which has a cabinet and the items to be fixed are located beneath countertop level and inside the cabinet, after opening the cabinet doors, the workman is not level with the workspace because the workspace is not level with the ground. When using the unit embodying the present invention, a wedge with a piece of foam padding that can be pressed up against a cabinet is positioned beneath the workman who lies supine on the pad. The unit includes a foam end which abuts the cabinet and the foam prevents the cabinet from being scratched and the wedge makes a comfortable, level work environment for the technician or plumber. One form of the unit is made of plastic, but other materials can be used without departing from the scope of the claims associated with this disclosure A clamp can be included to stabilize pipes being cut and supported on the unit as will be discussed below. The unit also includes a lift cover to close the compartments in which tools, parts and the like are stored.

The unit is large enough to comfortably accommodate a person's back. It is rectangular shape and has a slightly inclined top that opens and closes to allow for storage space. In one form, the inclined top is covered with foam-padding and/or rubber to provide cushioning for the user lying on it. Rubber and/or foam-padding can also be used on the front on the unit to prevent damage to a sink cabinet.

The unit embodying the present invention has multiple uses: a support; a tool box; and a work support.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 3 shows the top view of the unit of the present invention with a cover open to expose a plurality of compartments that are used to store items such as nuts, bolts and the like.

DETAILED DESCRIPTION OF THE INVENTION

Figure 1:
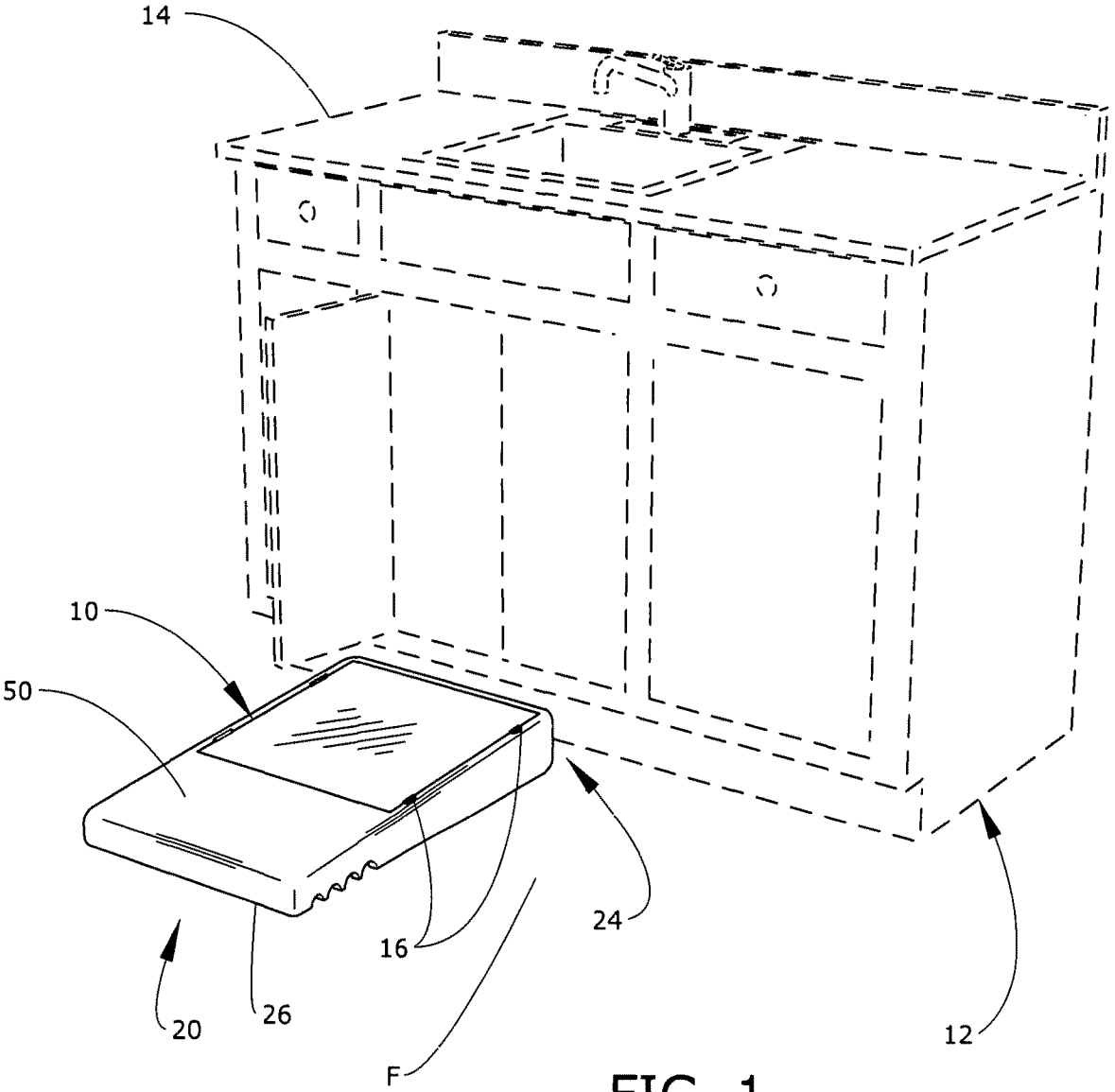
FIG. 1 shows the unit embodying the present invention in association with a cabinet.
Figure 2:
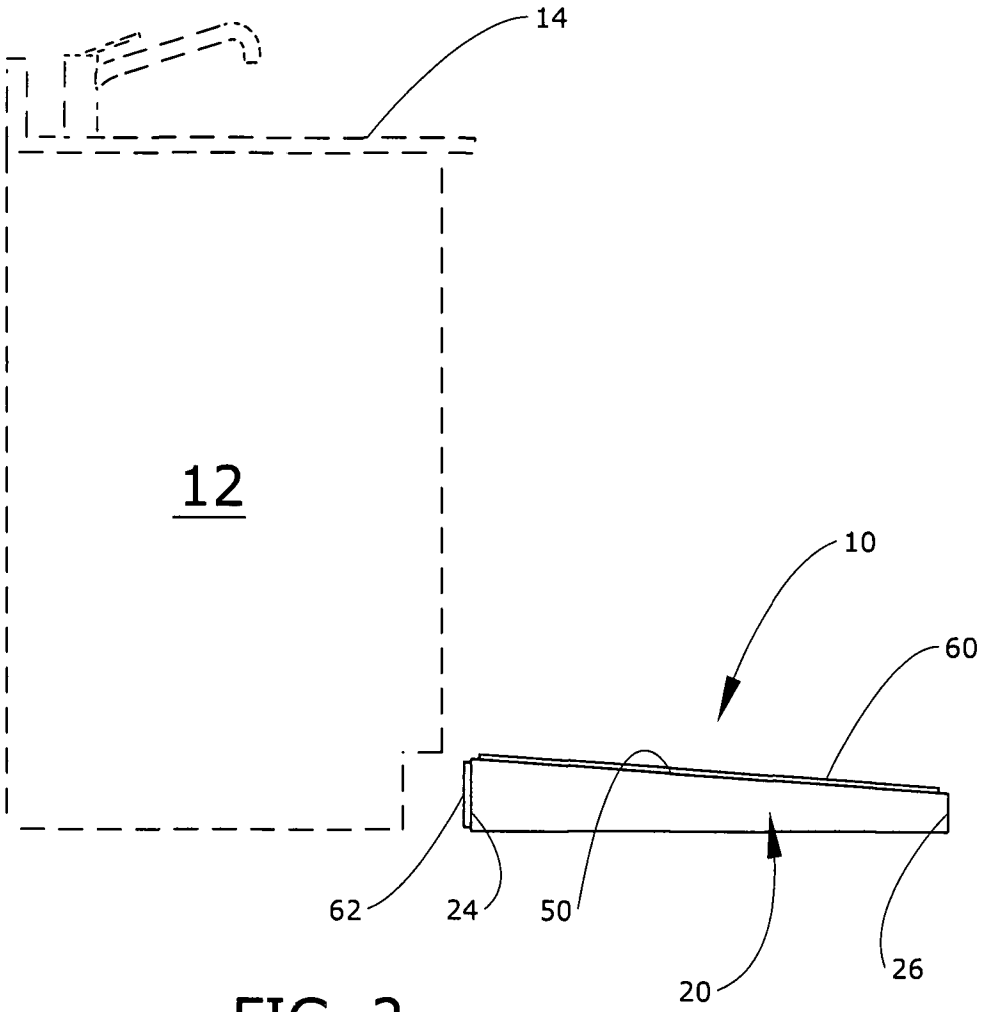
FIG. 2 shows a side view of the unit of the present invention in association with a cabinet.

Referring to the figures, it can be understood that the present invention is embodied in a unit 10 for supporting a worker during work on a workpiece located in a confined area, such as cabinet 12, that is below the level of a countertop 14. Such a confined area would be a kitchen sink unit or the like. However, other confined areas, such as bathroom sinks, or the like can be included in the scope of this disclosure. Unit 10 comprises a wedge-shaped body 20 having a first end wall 24 that is located closely adjacent to cabinet 12, a second end wall 26 spaced apart from the first end wall, a longitudinal axis 28 which extends between the first end wall and the second end wall, a first side wall 30, a second side wall 32, and a transverse axis 34 which extends between the first side wall and the second side wall. The end walls and the side walls each have a top edge 40 and a bottom edge 42. Bottom edges 42 of the end and side walls are co-planar with each other and rest on the floor F adjacent to the cabinet when body 20 is in position adjacent to the cabinet. Body 20 further includes a first surface 50 which is a top surface when the body is in position adjacent to the cabinet and is the surface on which a worker is supported when work is being performed in the confined area. A pad 60 is located on the first surface to support the worker. A further pad 62 is located on first end wall 24 to be interposed between the body and the cabinet to prevent marring of the cabinet by the body. Body 20 further includes a second surface 70 which is a bottom surface and which is spaced above floor F when the body is in position adjacent to the cabinet. As can be understood from the figures, by having bottom surface 70 spaced apart from and above the floor when the body is in position adjacent to the cabinet and the bottom edges of the side and end walls resting on the floor, the side walls and the end walls and the bottom surface of the body define a storage space 80 beneath the bottom surface of the body.

First end wall 24 has a width $W_{24}$ measured between the top edge of the first end wall and the bottom edge of the first end wall adjacent to the cabinet. Second end wall 26 has a width $W_{26}$ measured between the top edge of the second end wall and the bottom edge of the second end wall. Width $W_{24}$ of the first end wall is greater than width $W_{26}$ of the second end wall so the body is wedge shaped with the greatest width being located adjacent to the cabinet whereby the worker is supported in a position that is inclined upward from his feet toward his head. This allows the worker to work comfortably when he is in a supine position with his hands over his head, even for prolonged periods of time. First side wall 30 has a width $W_{30}$ measured between the top edge of first side wall 30 and the bottom edge of the first side wall. Second side wall 32 has a width $W_{32}$ measured between the top edge of the second side wall and the bottom edge of the second side wall. The thickness of the side walls adjacent to the first end wall is greater than the thickness of the side walls adjacent to the second end wall.

A plurality of first compartment-defining wall elements, such as wall element 90, are located in storage space 80 and extend between the first side wall and the second side wall in the direction of the transverse axis of the body. The first compartment-defining wall elements are spaced apart from each other and are parallel with each other and with the first and second end walls of the body. A plurality of second compartment-defining wall elements, such as wall element 92, are located in the storage space and extend from adjacent to the first end wall toward the second end wall in the direction of the longitudinal axis of the body. The second compartment-defining wall elements are spaced apart from each other and are parallel with each other and with the first and second end walls of the body. The first compartment-defining wall elements intersect the second compartment-defining wall elements to define a plurality of compartments, such as compartment 100, in the storage space. Slots, such as slot 102, are defined in the compartment-defining wall elements so these wall elements can be moved with respect to each other whereby the compartments are movable with respect to each. The compartments of the preferred form of unit 10 are arranged in a grid pattern.

Figure 3:
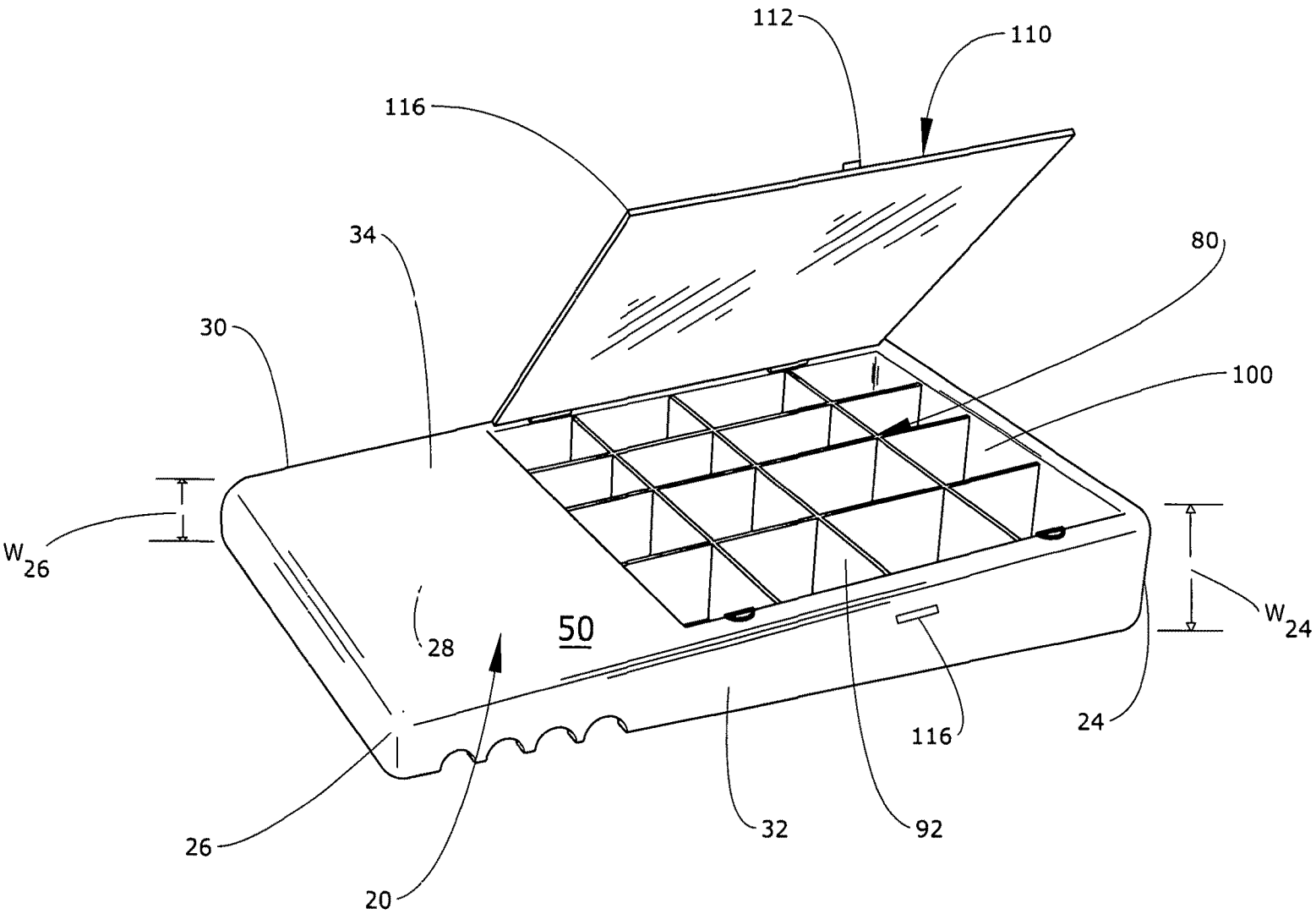

A translucent door 110 is hingeably mounted on first side wall 30 of the body to move between a first closed position covering the compartments and a second open position uncovering the compartments, with the door being shown in the open position in FIG. 3. A latch-engaging element 112 is located on door 110 adjacent to a distal edge 114 of the door, and a latch element 116 is located on second side wall 32. Latch element 116 is located to engage latch-engaging element 112 on the door when the door is in the closed position. If suitable, more than one latch/latch-engaging combination can be used to ensure the door is securely held in a closed position.

Unit 10 further includes a pipe workpiece support system 120 located adjacent to the first end wall. In the preferred form of unit 10, workpiece support system 120 is a pipe workpiece support system and includes a plurality of semi-circular notches, such as notches 130-136 defined in edge 138 of second side wall 32. Edge 138 is a bottom edge of the side wall and rests on the floor when the unit is in use. Notches 130-136 are spaced apart from each other. Each notch has a diameter which is different from a diameter of an adjacent notch.

Unit 10 further includes a plurality of blind-ended bores, such as blind-ended bore 140, defined in the first side wall. Each blind-ended bore is located to cooperate with an associated notch in the second end wall. Each of the blind-ended bores has a diameter which corresponds to the diameter of the associated notch.

Figure 4:
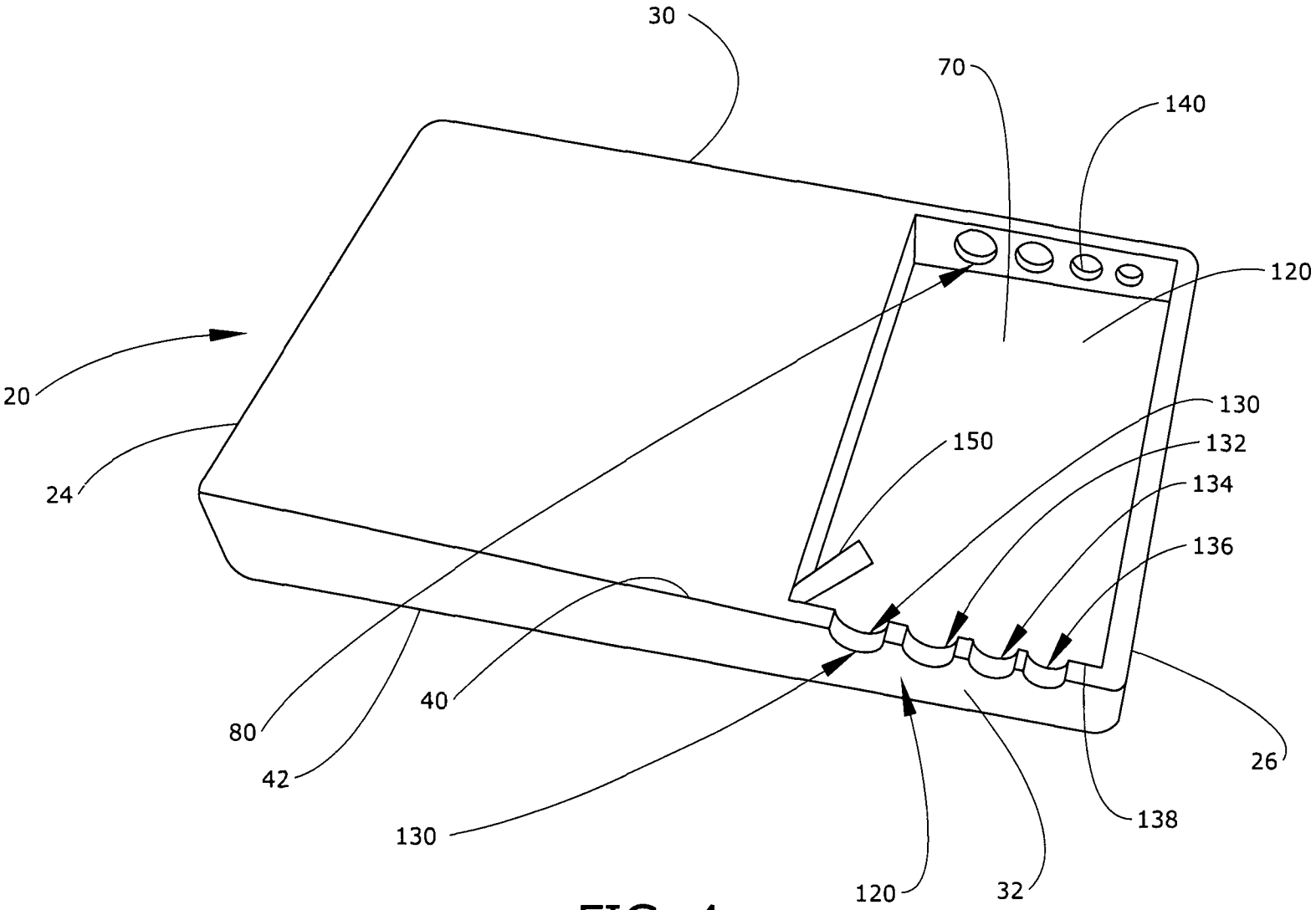
FIG. 4 shows a bottom view of the unit of the present invention with the notches and blind-ended bores used to support pipes to be cut.
Figure 5:
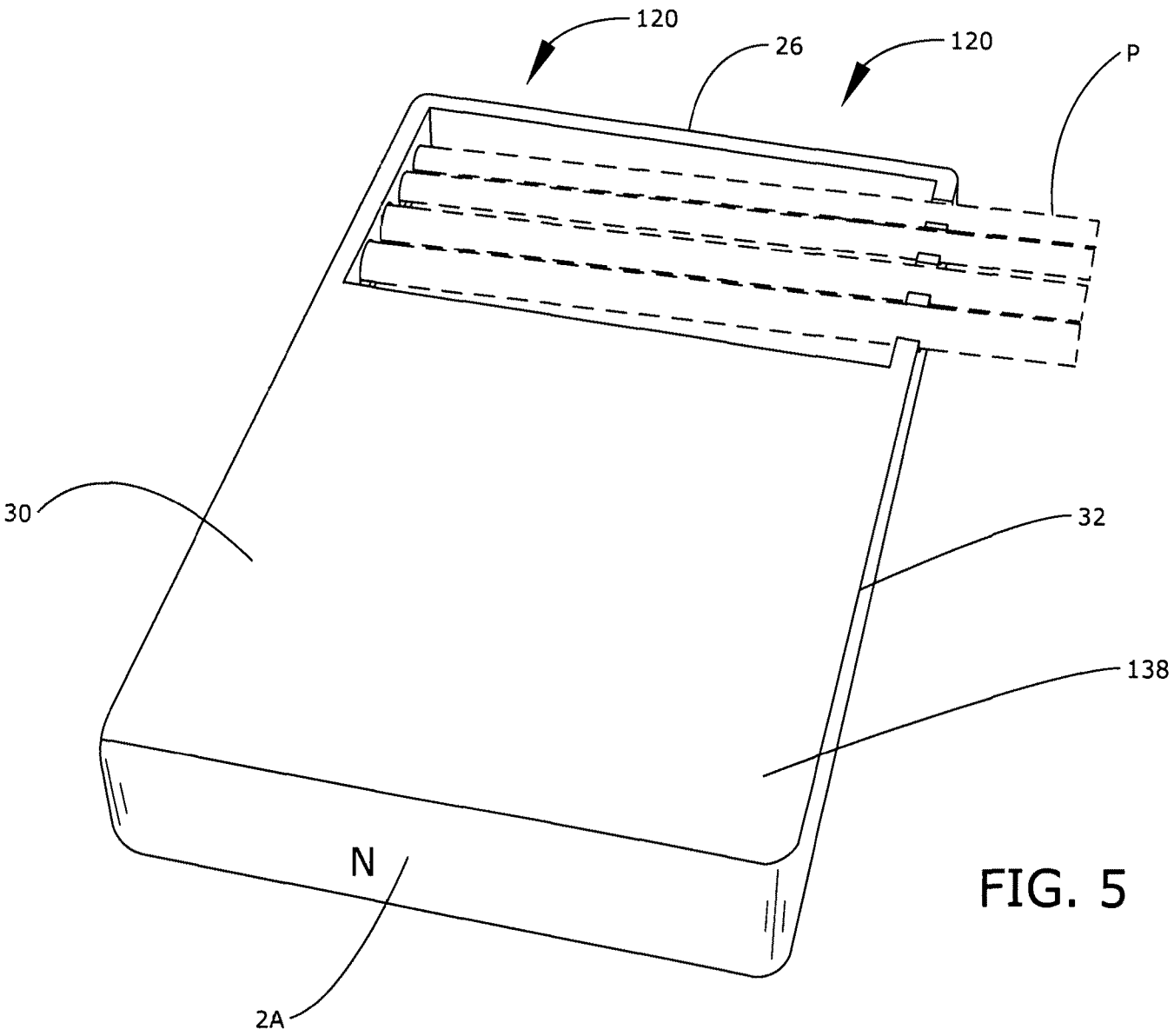
FIG. 5 shows a bottom view of the unit of the present invention with the notches and blind-ended bores used to support pipes to be cut.

As can be understood from FIG. 5, pipes, such as pipes P, are supported in the notches and extend transversely across unit 10 and have ends thereof supported in the blind-ended bores. The different sized notches and bores accommodate pipes having different outer dimensions. If desired, a clamp 150 (indicated only schematically in FIG. 4) can be hingeably mounted on second side wall 32 adjacent to the notches to help hold a workpiece in the notches while it is being worked on. The clamp can extend over all of the notches or over only selected notches. In this manner, unit 10 has multiple uses: a support; a tool box; and a work support.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A unit for supporting a worker during work on a workpiece located in a confined area that is below countertop level, the unit comprising:

wedge-shaped body having a first end wall that is located closely adjacent to a cabinet which contains a workpiece to be worked on, a second end wall spaced apart from the first end wall, a longitudinal axis which extends between the first end wall and the second end wall, a first side wall, a second side wall, a transverse axis which extends between the first side wall and the second side wall, the end walls and the side walls each having a top edge and a bottom edge, the bottom edges of the end and side walls being co-planar with each other and resting on the floor adjacent to the cabinet when the body is in position adjacent to the cabinet, the body further including a first surface which is a top surface when the body is in position adjacent to the cabinet, a second surface which is a bottom surface and which is positioned above a floor when the body is in position adjacent to the cabinet, the bottom surface being spaced apart from the floor when the body is in position adjacent to the cabinet and the bottom edges of the side and end walls are resting on the floor, the side walls and the end walls and the bottom surface of the body defining a storage space beneath the bottom surface of the body, the first end wall having a width measured between the top edge of the first end wall and the bottom edge of the first end wall, the second end wall having a width measured between the top edge of the second end wall and the bottom edge of the second end wall, the width of the first end wall being greater than the width of the second end wall, the first side wall having a width measured between the top edge of the first side wall and the bottom edge of the first side wall, the second side wall having a width measured between the top edge of the second side wall and the bottom edge of the second side wall, the thickness of the side walls adjacent to the first end wall being greater than the thickness of the side walls adjacent to the second end wall, the body being wedge-shaped and sloping from adjacent to the first end wall towards the second end wall;

a plurality of first compartment-defining wall elements located in the storage space and extending between the first side wall and the second side wall in the direction of the transverse axis of the body, the first compartment-defining wall elements being spaced apart from each other and parallel with each other and with the first and second end walls of the body, a plurality of second compartment-defining wall elements located in the storage space and extending between from adjacent to the first end wall toward the second end wall in the direction of the longitudinal axis of the body, the second compartment-defining wall elements being spaced apart from each other and parallel with each other and with the first and second end walls of the body, the first compartment-defining wall elements intersecting the second compartment-defining wall elements to define a plurality of compartments in the storage space, the plurality of compartments being arranged in a grid pattern, a door hingeably mounted on the first side wall of the body to move between a first closed position covering the compartments and a second open position uncovering the compartments, the door having a latch-engaging element thereon;

a latch on the second side wall, the latch being located to engage the latch on the door when the door is in the closed position; and a pipe workpiece support system located adjacent to the first end wall, the pipe workpiece support system including a plurality of semi-circular notches defined in the bottom edge of the second side wall, the notches being spaced apart from each other, each notch having a diameter which is different from a diameter of an adjacent notch, and a plurality of blind-ended bores defined in the first side wall, each blind-ended bore being located to cooperate with a notch in the second end wall.

2. The unit defined in claim 1 wherein the compartment-defining wall elements are movable with respect to each other to adjust the size of the compartments.

3. The unit defined in claim 2 wherein the door is translucent.

4. The unit defined in claim 3 further including a pad on the top surface of the body.

5. The unit defined in claim 2 further including a pad located on the second end wall to be interposed between the second end wall and the cabinet when the body is in position adjacent to the cabinet.

6. The unit defined in claim 2 wherein the compartment-defining wall elements have slots defined therein.

7. A unit for supporting a worker during work on a workpiece located in a confined area that is below countertop level, the unit comprising:

wedge-shaped body which includes a first end that is located adjacent to a confined area in which work is being performed by a worker supported on the body, a second end spaced apart from the first end, the second end of the body being narrower than the first end of the body to define the wedge shape of the body, a first surface on which the worker is supported, and first and second side walls on the first surface, the first and second side walls having edges supported on a floor adjacent to the confined area and supporting the first surface above the floor adjacent to the confined area, a storage area being defined between the first surface and the side walls; and a workpiece supporting portion on the body, the workpiece supporting portion including a plurality of cutouts defined in the edge of the first side wall, a plurality of blind-ended bores defined in the edge of the second side wall, each of the blind-ended bores being associated with a corresponding cutout.

8. The unit defined in claim 7 further including a plurality of compartment-defining wall elements located in the storage area, the compartment-defining wall elements being arranged in a grid pattern to define a plurality of compartments in the storage area.

9. The unit defined in claim 8 wherein the compartment-defining wall elements are movable with respect to each other.

10. The unit defined in claim 8 further including a door hingeably mounted on the second side wall.

11. The unit defined in claim 10 further including a latch on the first side wall and a latch-engaging element on the door.

12. The unit defined in claim 11 further including a clamp hingeably mounted on the second side wall adjacent to the cutouts.

* * * * *